United States Patent [19]

Fischer

[11] 4,143,297

[45] Mar. 6, 1979

[54] INFORMATION DISPLAY PANEL WITH ZINC SULFIDE POWDER ELECTROLUMINESCENT LAYERS

[75] Inventor: A. G. Fischer, Dortmund, Fed. Rep. of Germany

[73] Assignee: Brown, Boveri & Cie Aktiengesellschaft, Mannheim, Fed. Rep. of Germany

[21] Appl. No.: 715,715

[22] Filed: Aug. 19, 1976

[30] Foreign Application Priority Data

Mar. 8, 1976 [DE] Fed. Rep. of Germany ..... 2609460

[51] Int. Cl.[2] ..... H05B 33/14; H05B 33/20; H05B 33/26

[52] U.S. Cl. ..... 313/502; 313/503; 313/509

[58] Field of Search ..... 313/503, 504, 506, 502, 313/509

[56] References Cited

U.S. PATENT DOCUMENTS

| | | | |
|---|---|---|---|
| 2,924,732 | 2/1960 | Lehmann | 313/506 |
| 2,941,104 | 6/1960 | Swindells | 313/503 X |
| 2,951,865 | 9/1960 | Jaffe et al. | 313/502 X |
| 3,037,138 | 5/1962 | Motson | 313/502 |
| 3,052,810 | 9/1962 | Mash | 313/506 |
| 3,201,633 | 8/1965 | Lieb | 428/433 X |
| 3,461,075 | 8/1969 | Manson et al. | 313/502 X |
| 3,480,818 | 11/1969 | Te Velde | 313/503 X |
| 3,919,589 | 11/1975 | Hanak | 313/506 X |
| 4,035,686 | 7/1977 | Fleming | 313/504X |

*Primary Examiner*—Palmer C. Demeo
*Attorney, Agent, or Firm*—Thomas H. Murray

[57] ABSTRACT

Electroluminescent information display panels are disclosed suitable for uses extending from simple numeric displays to color TV panels. The new panel consists of an unpatterned layer of electroluminescent powder particles of thickness equal to that of one particle embedded in a high-dielectric resin with a transparent front electrode and a black back electrode to increase visual contrast. The operating voltage is low enough to permit use of common transistors for addressing the lighting segments of the display and a new resonant circuit is provided for this purpose. The new electrode pattern is deposited on the black back layer of the panel and the electrical circuits are placed on a second rear substrate and connected to the front plate. The electrical circuits may consist of coextensive matrices of interconnected thin-film transistors driven from the side by shift registers and line storage registers.

7 Claims, 16 Drawing Figures

Fig. 6
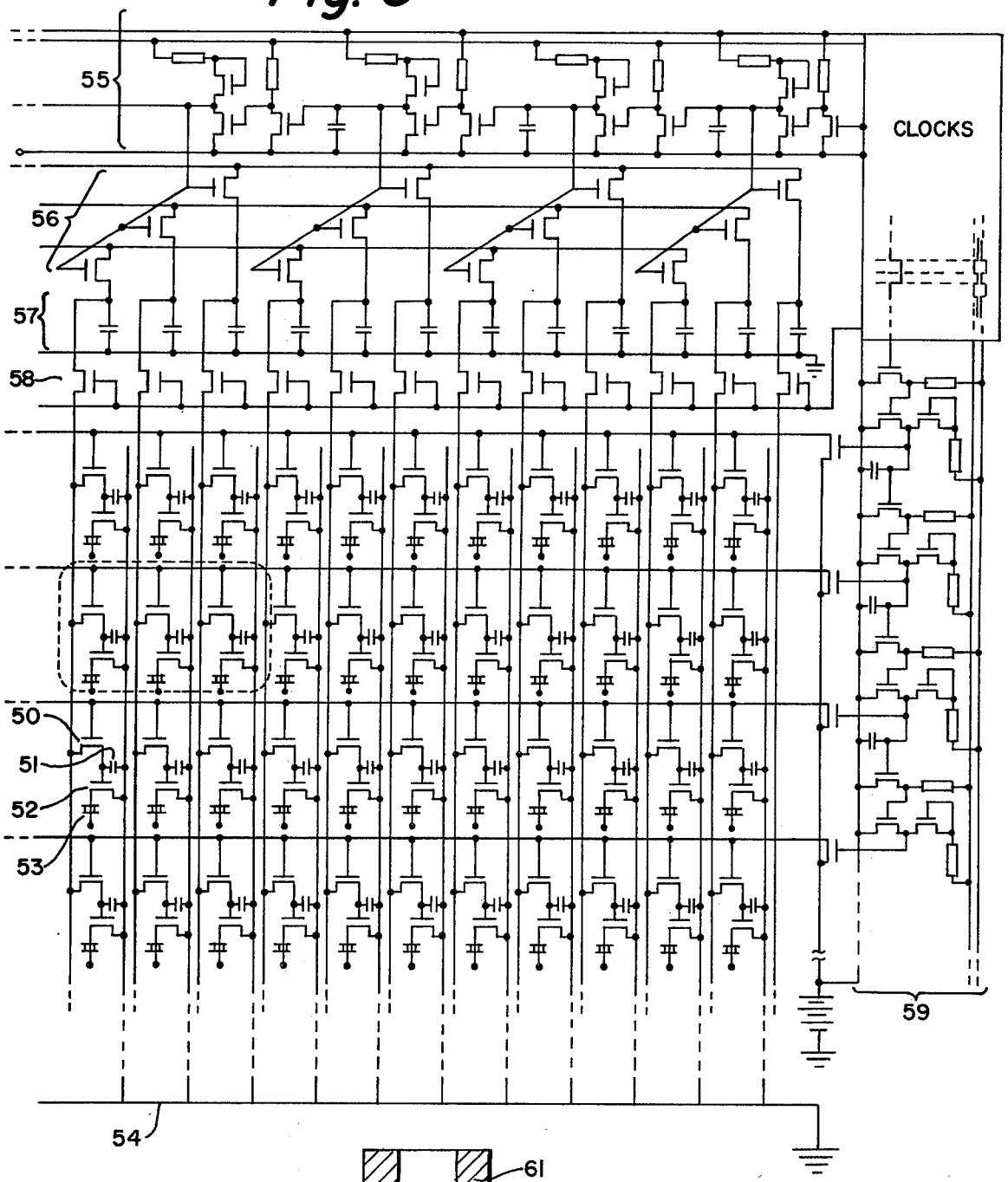
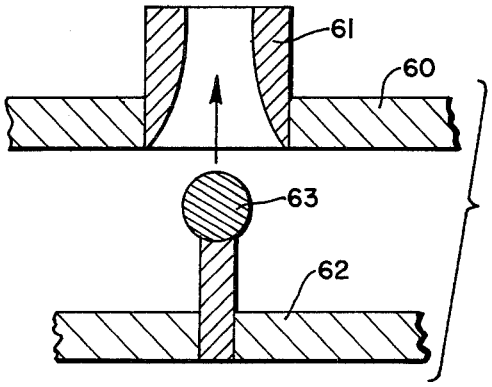
Fig. 7

Fig. 9
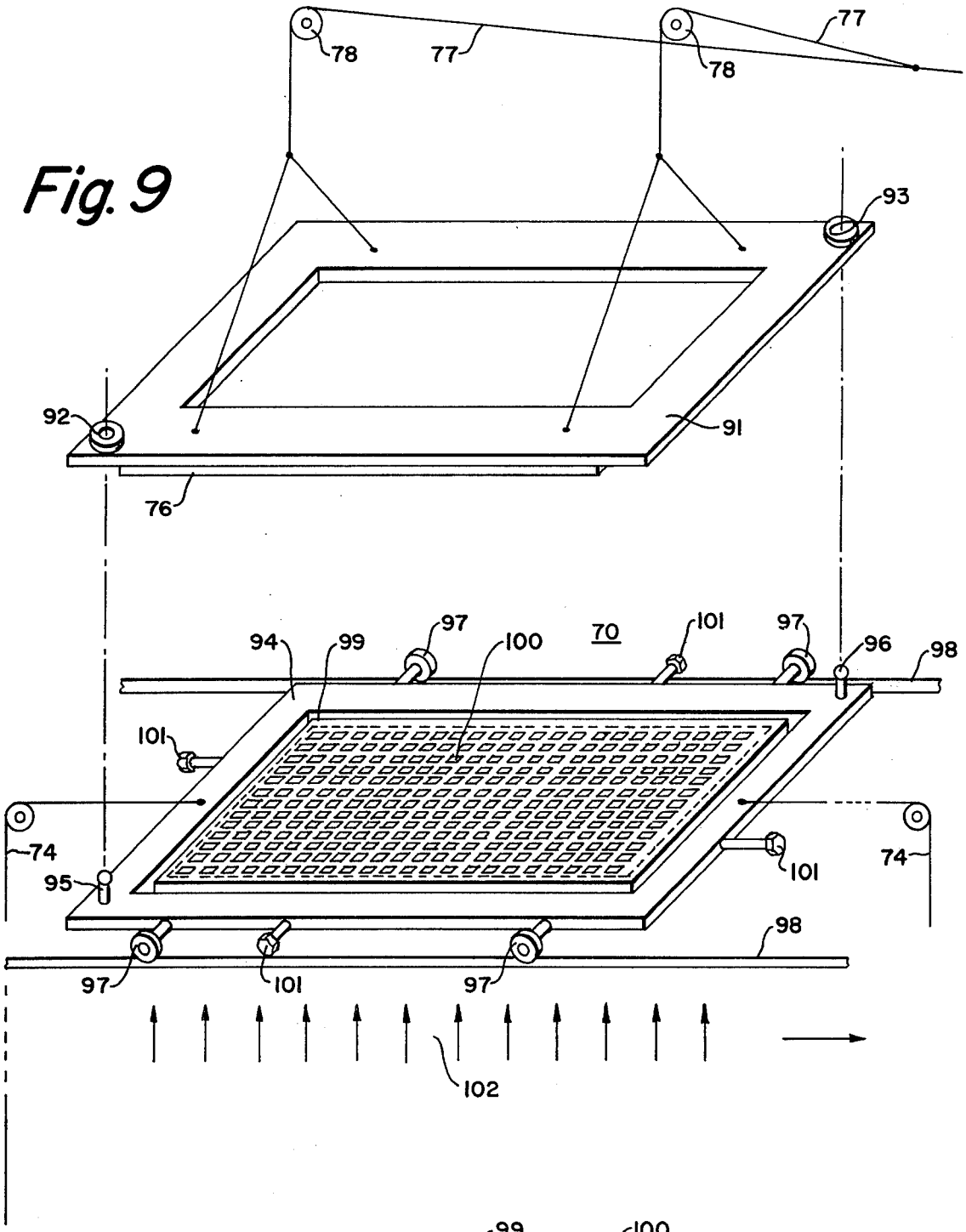
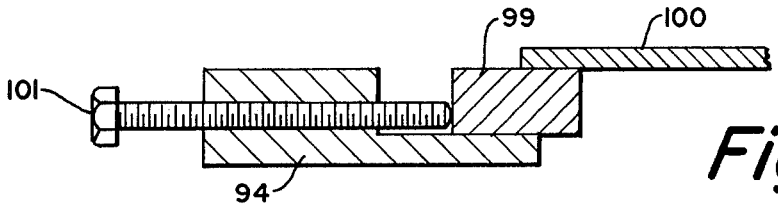
Fig. 9A

INFORMATION DISPLAY PANEL WITH ZINC SULFIDE POWDER ELECTROLUMINESCENT LAYERS

BACKGROUND OF THE INVENTION

The "luminous capacitor", invented in 1936 by G. Destriau in Marseille, is known to consist (in its later, developed form) of a front glass plate covered with conducting, transparent oxide such as tin oxide or indium oxide, a resinous or vitreous insulator layer into which is embedded suitably-prepared electroluminescent (EL) zinc sulfide powder (basically ZnS supersaturated with copper), and a metallic rear electrode plate. Light is emitted if a high, audio-frequency electric field is applied.

This effect was developed to the state of practical applicability in the USA up to the years 1963–1964 but was then dropped because these luminous panels did not immediately satisfy all expectations. Besides, at that time the light-emitting diodes (LEDs) were coming up and diverted public attention.

The physical mechanism of light generation in embedded ZnS particles in high fields, as explained by A. G. Fischer in 1962, consists of alternate bipolar carrier injection from conducting copper precipitates into the surrounding luminescent ZnS host lattice, and radiative recombination at each field reversal.

One reason why these luminous panels were abandoned was that in brightly-lit rooms the visual contrast of EL information displays was poor, i.e., addressed elements of a display were hard to distinguish from unaddressed ones. This is because the body color of these panels is near-white, owing to the high refractive index ($n = 2.4$) of the white ZnS powder in its binder (like white paint). Therefore, the panel reflects much of the ambient light into the eye of the observer. For good readability the contrast of a display (the brightness quotient between an addressed segment and its background) should be at least as high as 6-fold. This means that the addressed elements should send 6 times as much light into the eye of the observer as is reflected there from the ambient illumination by the background of the addressed segment. This requires a high luminous intensity of the display segment, but high intensity is indeed difficult to obtain from these EL layers.

SUMMARY OF THE INVENTION

A new layer structure of the luminous capacitor type of electroluminescent panels (Destriau effect) for information display purposes (as opposed to general lighting purposes) is described, which can be applied, without basic changes, from simple 7-segment numeric displays all the way up to a flat color TV panel. It consists of an unpatterned "monoparticle" powder layer, i.e., a layer composed of powder particles which is only as thick as one particle, embedded in a high-dielectric resin, with a transparent front electrode and with a black back electrode. The latter increases visual contrast in bright ambient. To prevent electrical breakthroughs of the very thin layers, both electrodes are coated with vacuum-deposited oxide films which act as efficient insulators. Due to the thinness of the layer, and due to the high dielectric constant of the embedding resin, the operating voltage is now so low (50 V) that common transistors can be used for addressing the lighting segments of the display. The driving circuit is a novel LC resonant circuit, with the EL layer acting as the capacitive element, the simplest version of this driver consisting of only one transistor, one ferrite shell core, and one resistor. White-emitting EL layers can be made by mixing blue-emitting EL powder and yellow-emitting EL powder in the same cell. Even simpler, blue-emitting EL powder can be embedded in resin that is dyed with yellow-fluorescing organic pigments which are excited by the blue EL emission. For color TV panels, the formation of triad patterns becomes possible by using blue-emitting EL powder embedded in resin pads which are alternately clear, dyed with green-fluorescing pigment, and dyed with red-fluorescing pigment. These pads can be produced by printing, or by photoresist technology. Another way to obtain red, green and blue color dot matrices is to place a rastered color mosaic film filter over a white-emitting EL layer. Still another way to produce red, green and blue matrix patterns is by dusting of tacky dots or stripes with EL powder.

A new panel structure has been found which employs on the front substrate unpatterned front electrodes, EL layers and black rear layers. The rear electrode pattern is deposited on this black insulating rear layer. The current leads and switches are all placed on a second, rear substrate and are connected to the front plate by resinous connectors. The maintenance of EL powders, or their aging characteristics, has been improved by doping both with halogen and with aluminum, by treatment under high sulfur pressure, and by passivating the particle surface to electrolysis by moisture. For flat TV, these EL layers are produced on top of coextensive matrices of interconnected thin-film transistors which are driven from the side by shift registers and line storage registers. The required complete circuit has been designed. New mask technologies have been devised to deposit the X-Y matrix and the peripheral registers onto the rear glass plate within one vacuum cycle.

BRIEF DESCRIPTION OF THE DRAWINGS

The invention will be more fully understood from the following detailed description, taken in connection with the accompanying drawings, in which:

FIG. 6 is a schematic diagram of a transistor matrix for a TV panel;

FIG. 7 is a diagrammatic illustration of a guide for accurate registration;

FIG. 9 is an enlarged exploded view of a portion of FIG. 8;

FIG. 9A is a detail view of an adjustment screw used in the apparatus of FIG. 9;

DESCRIPTION OF PREFERRED EMBODIMENTS

Figure 1:
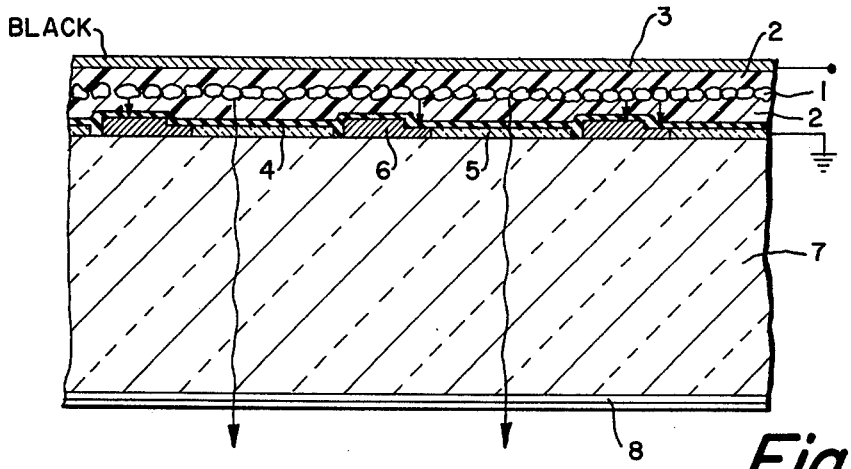
FIG. 1 is a diagrammatic sectional view of an EL panel illustrating the principle of the invention.

The drawbacks of the prior art discussed above can be overcome as follows, according to this invention: Rather than loading the embedding resin layer highly with ZnS powder, with random orientation of the powder grains, we use only one densely-packed layer of particles, this layer being one particle diameter thick, the so-called monoparticle layer as shown diagrammatically in FIG. 1. In this particular embodiment, the EL powder particles 1 are embedded in monolayer form in the resinous binder 2, this layer being contacted in the rear by the black back electrode 3. In front, the layer is coated by an evaporated insulating oxide film 4 such as $Y_2O_3$, which is followed by the transparent, conducting front electrode 5 which can consist of $SnO_2$:Sb or of $In_2O_3$:Sn applied by pyrolysis or by sputtering, or of a very thin transparent gold layer. The conductivity of this transparent, conducting front electrode 5 can be reinforced by vacuum-deposited metal stripes 6 which, at the same time, can be used to contain thin-film-transistor switches as described hereinafter.

This monoparticle structure has a much lower tendency to scatter light and to reflect light than the formerly-used thick, densely-packed powder layers with random arrangement of the particles.

Furthermore, we no longer use a silvery-reflecting back electrode as was done in the past, but a black back electrode. Therefore, only a small amount of the incident ambient light is scattered into the eye of the observer by the front and rear surfaces of the powder particles. Moreover, in order to eliminate the light reflected at the rear particle surfaces, the embedding resin next to the black back electrode can be dyed black too, by means of non-ionic organic pigments.

The luminous capacitor, in its unaddressed state, now looks dark grey when viewed in bright ambient light. If a segment of this panel is electrically addressed to emit light, it is true, of course, that half of the emitted photons, namely the ones which are emitted backwards toward the black rear electrode, are lost there, by absorption. Only the photons which are emitted to the front reach the eye of the observer. However, this remaining half of the emitted light must no longer compete with the reflected ambient light in the retina of the observer because there is hardly any reflected light, owing to the dark-grey background. If this background would be 100% black, the viewing contrast would be completely independent of the ambient brightness (assuming, that in FIG. 1 the glass substrate 7 carries, additionally, an antireflection coating 8.)

Therefore, the new EL display panels according to this invention can be made with high visual contrast in normal roomlight ambient. Typical emission colors are blue, green or yellow. As alphanumeric displays, these panels are superior to the single-crystalline III–V LEDs because they can be made in large area, in any color, and at a low price.

Another drawback of the early EL panels which led to their abandonment was the necessity to operate them with very high voltage (several hundred volts). Segments of such a display could be switched only by means of electromagnetic relays since common, inexpensive transistors were not available for these operating voltages. Besides, since EL brightness goes up with frequency of the ac voltage, the panels could not be brought to useable brightness with just 60 Hz line frequency but required special power supplies, to deliver hundreds of volts at several thousand Hz. These power supplies were big expensive black boxes imbued with high conversion losses. They thus annihilated the initial advantage of the EL panel as a compact, light, flat light source.

According to this invention, also these shortcomings of the early EL panels have now been overcome. Since our monoparticle layers are only aoubt 10 microns thick, as compared to the 50–100 microns of the past, lower voltages suffice to achieve the same field strength inside the grains. Accidental shorting of the electrodes by particle bridges are no longer possible in our structure since the insulating oxide films on the electrodes, which are about 0.5 microns thick, can sustain 150V without puncture. They relieve the resin layer of electrical stress.

We have chosen the embedding resin 2 so that it has a very high dielectric constant ($\epsilon = 20$) compared to that of the ZnS powder 1 embedded in it. Thereby we make good use of the well-known layered dielectric effect: In a dielectric consisting of three sandwiched layers such that the central layer has the lowest dielectric constant $\epsilon_1$, whereas the external layers have higher values $\epsilon_2$, the electric field in the central layer is $\epsilon_1/\epsilon_2$ times higher than the field in the external layers. This increased field strength E in the central ZnS layer strongly increases the emitted brightness B, since according to $$B = \text{Const. exp} - (b/E^{\frac{1}{2}}) \qquad (b = \text{const.})$$

the brightness depends very strongly on the acting field E. This high-dielectric embedding resin thus leads to a manyfold increase in luminous brightness of the panel for the same externally-applied voltage. Or, in other words, a given brightness can be reached with much lower voltage if this high-dielectric resin is used. This resin is preferably cyanoethyl starch plasticized with cyanoethyl sucrose as described below.

Since at each half-wave of the applied sinusoidal voltage a local breakdown occurs in the powder particles, resulting in a light flash, the integrated brightness increases linearly with drive frequency until saturation occurs. It is desirable, therefore, to operate the panels at high frequency, say 10 kHz.

Figure 2:
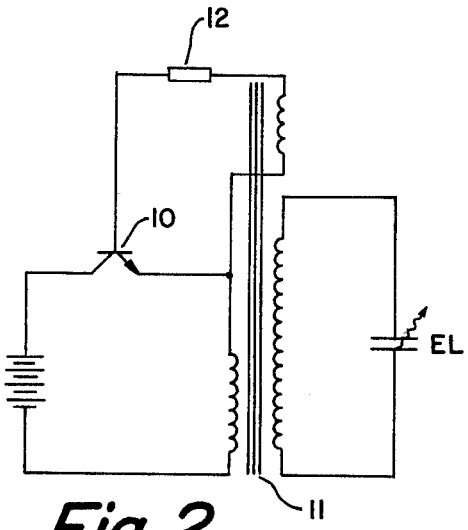
FIG. 2 is a schematic diagram of a power supply.

According to this invention we have found that the big audio-frequency power supply of the past, which was very objectionable and was another reason why EL did not succeed, can be abolished and replaced by a very simple oscillator. In its simplest, stripped-down version, shown in FIG. 2, it consists of one transistor 10, one ferrite shell core 11 with 3 windings and a resistor 12. This tiny capsule converts battery voltage to 10 kHz, 50 V with 80% efficiency. It is cheaper to construct than a dc power supply. Therefore, the former objections to the requisite audio frequency drive of EL panels are no longer true. The transistor 10 can be type Valvo BD 115, the ferrite shell core (with air gap) can be type Siemens 561N22F02,160 and carries 25 turns on the primary winding, 350 turns on the secondary winding, and 20 turns in the tickler winding. The resistor has 500 ohms. The battery is 6 V.

Without commenting at this point on the lateral structure aspects of such panels which, of course, are entirely different for a 7-segment numeric display than for a flat TV panel, we describe next, as a practical example of the embodiment of this invention, the production steps of such an electroluminescent panel from front to rear.

Figure 3:
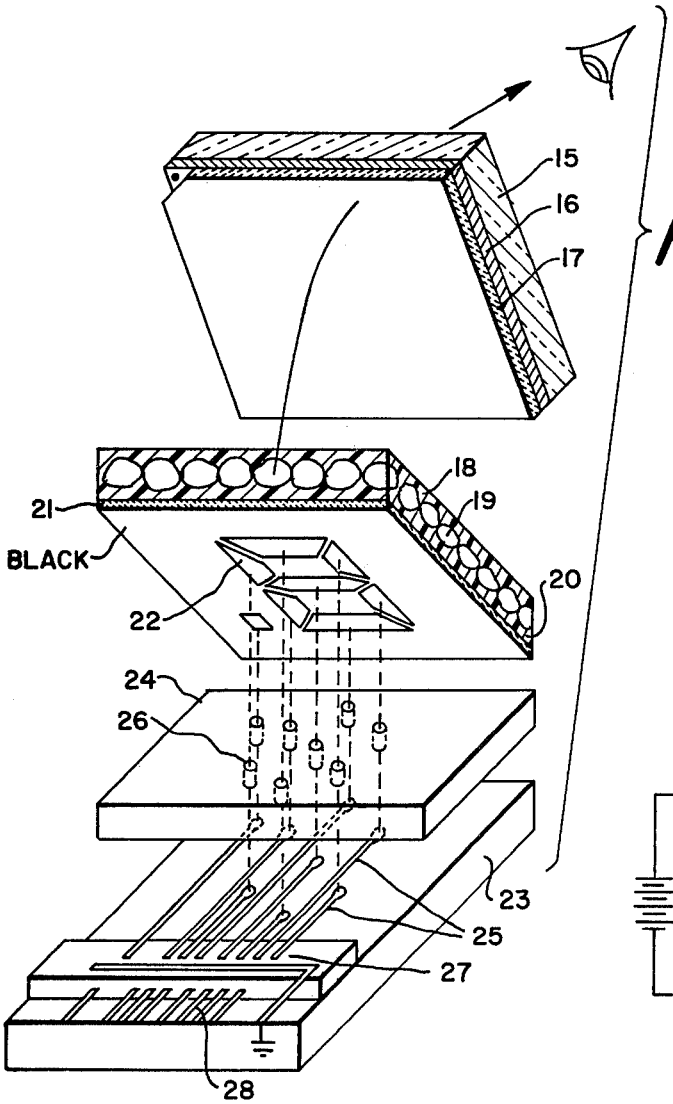
FIG. 3 is a diagrammatic exploded view illustrating the construction of an EL panel.

This is illustrated in FIG. 3 which, for the sake of definiteness, describes a 7-segment display.

As a transparent substrate and as a front electrode we use, in this example, a glass plate 15 coated with conducting, transparent indium oxide or tin oxide 16 having, typically, a surface resistivity of 20 ohm/square and a transmissivity for light of 80%. Such glass plates can be purchased, for example, from PPG Industries, Pittsburgh, PA. Also glass plates with a thin, vacuum-deposited transparent metal film, as presently employed as a heat shield on windows of buildings, are useable, for instance a 40 Å thick gold film between two evaporated $Bi_2O_3$ or $PbO_2$ films of 500 Å thickness.

This transparent front substrate is now coated in vacuum with a thin, transparent insulating layer 17. For this we use oxides of high heat of formation (since they are the most stable ones) such as $Al_2O_3$, $Y_2O_3$, or $HfO_2$. Since these oxides are very refractory, they have to be evaporated by electron beam heating. The appropriate film thickness should be 0.4–0.8 micron. Only the contact pad to the conducting oxide coating underneath remains uncoated by this insulating film.

After removal from the vacuum system the front substrate plate is now coated by a layer of clear lacquer of about 10 micron thickness 18. This can be accomplished by spraying, or by centrifugal spreading, or by silk screening. As mentioned, a suitable resinous lacquer material for this is cyanoethyl starch plasticized by about 50% of cyanoethyl sucrose. Dimethyl formamide and/or acetonitrile can be used as solvents. This resin has a dielectric constant of 20 and is thus uniquely suited for our purpose. As compared to a normal paint lacquer of a dielectric constant of 3 it increases the luminous brightness of our display 10-fold.

After drying of the lacquer the substrate is now heated to 150° C. so that the lacquer turns thermoplastic and tacky. It is a surprise that the lacquer can do this since the cyanoethyl starch by itself is a duroplast. Only by the addition of the cyanoethylated sucrose does it become a thermoplast.

Onto this tacky resin layer, a small heap of electroluminescent ZnS powder is now poured, and is spread sideways by means of a soft hair brush, or by tilting the substrate. The powder particles sink into the soft lacquer and get attached to it on their undersides. After cooling, the excessive, loose powder is removed by inverting the substrate and by tapping it.

The result is a dense monoparticle layer 19 of EL particles. Onto this, a further layer of resin is applied by spraying so that the powder particles are surrounded by resin. If this second resin layer 20 is made very thin, a second monoparticle layer can be applied, and onto this a third one, and so on. Such triple or multiple monoparticle layers will be used, as we shall see below, for color television panels and for rear-illuminating liquid crystal display panels.

Coming back to simple monograin layers, this second resin layer 20 can be made as thick as the first one 18, for space-charge symmetry and thus longer EL life. If good visual contrast of the display is desired, the second resin layer can be dyed with black, non-ionic pigments such as Zapon Black RE of the BASF Company of Ludwigshafen, Germany, so that the rear parts of the particles are embedded in black material, eliminating the possibility of ambient light reflection there.

This resin layer 20 is followed by the rear oxide film 21. It should consist of a similar material to the first oxide film 17, for reasons of space charge symmetry and long-life as before. Besides, this second oxide film should be black in order to increase visual contrast. We have found that cermets are very suitable for preparing insulating, black films. Cermets are oxides or fluorides containing colloidal suspensions of metals. For example, one can evaporate simultaneously $Al_2O_3$ and Al, or $Al_2O_3$ and Cr and Ni and Fe, or one can evaporate $Bi_2O_3$ very rapidly such that the resulting film turns oxygen-deficient or metal-rich. There is a large number of suitable cermet combinations. The use of cermets for making optically black layers which also are good insulators was unknown so far.

This second oxide layer 21 is optically black whereas the first one 17 was optically clear. It is followed by the metallic-conducting rear electrode 22 or electrodes. Since in displays this rear electrode consists of many independent segments, it is applied by vacuum-deposition through a mask, or by silk-screening with conducting silver paint.

It is important that the symmetrical arrangement of the layers is maintained. In the sequence front electrode — oxide film — resin — monoparticle layer — resin — oxide film — electrode similar materials and equal thicknesses should be used so that no one-sided space-charge conditions can form during high-field ac operation. This would lead to ion migration and EL deterioration.

Since humidity will lead to electrolytic decomposition at the ZnS-resin interface with darkening, gas development and immigration of vacancies, it is necessary to exclude access of moisture in the ambient from the pervious rear surface of the panel. This is achieved by a second glass plate 23 which is sealed-on with epoxy resin or with a thermoplastic resin or wax 24. Before this is done, however, this glass plate 23 is utilized to carry the current leads 25 which are vacuum-deposited or printed-on or painted-on. Electrical connection between these current leads 25 and the rear electrode segments 22 on the front panel is made by means of the resinous connectors 26 penetrating the resin 24. These can be screened-on using silver-epoxy or, preferably in order to avoid local stress points, using an elastic, conducting silver-silicone rubber compound that is commercially available.

The glass strip containing a row of thin-film transistor switches 27, and the connection strip 28, will be described hereinafter.

According to this invention, placement of the current leads 25 which power the rear EL electrode segments 22, on this second glass plate 23 which also seals out moisture, brings the important advantage that the visible front layers (16, 17, 18, 19, 20 and 21) can now be uniform and unpatterned. This not only improves visual contrast and the esthetics of the display, which, in the unaddressed state, looks uniformly dark-grey, with the segments being indistinguishable from the background, but it also eases manufacture of these layers. Most importantly, it permits close spacing of the numerals. If the current leads to the electrode segments would have to be arranged laterally, it would be impossible to place the numerals close together. A nine-numeral calculator display would be too long. As pointed out before, this arrangement, with modifications, will recur when we discuss the construction of flat television panels below.

Next we have to describe the new methods which we use to electronically address our multielement electroluminescent display panels. Contrary to LED displays which can be multiplexed, i.e., which can be addressed by very short, intense periodic current pulses, with long intermittent pauses during which the sluggishness of the retina of the observer integrates these light bursts into a steady perception, ac electroluminescent light sources can not be multiplexed but have to be driven during the total display time. This is because the luminous intenisty of EL displays can not be increased momentarily to very high values. The high ac voltage required for this would lead to punctures of the layers. Therefore, the addressing dc pulse that is supplied by an integrated logic circuit must be utilized to charge a small capacitor which keeps the gate of the associated field-effect transistor in the "on"-state so that the ac power can reach the EL display segment for the extended time until a new addressing dc pulse occurs.

Figure 4:
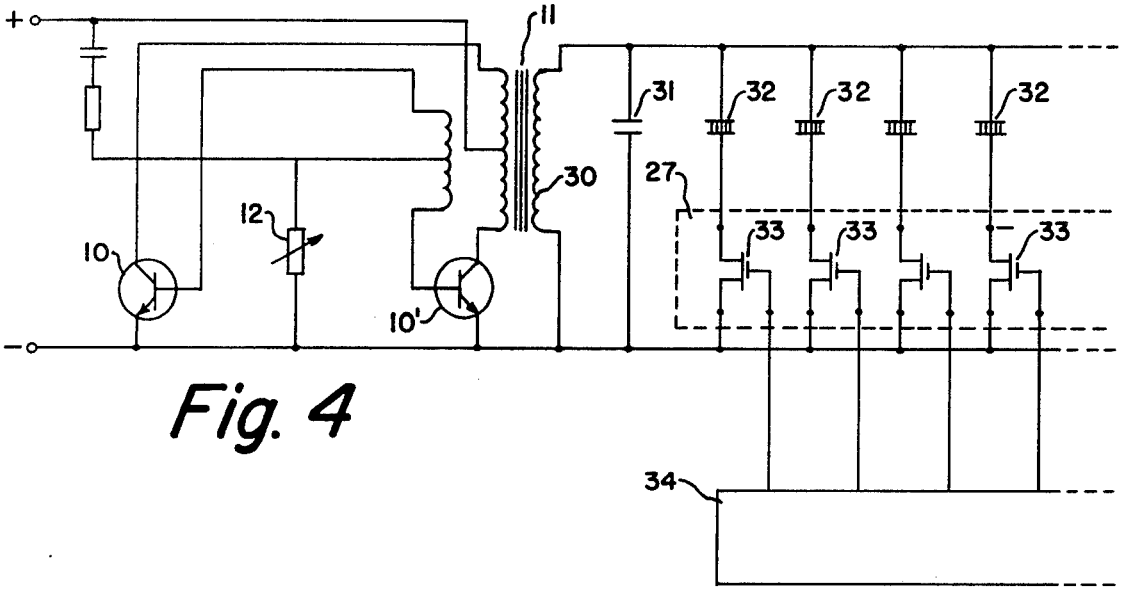
FIG. 4 is a schematic diagram of an address system for an EL panel.

In FIG. 4, this is illustrated for a 7-segment display; the same principle applies also for flat TV panels. For supplying the 50V, 10 kHz drive power, we have a push-pull oscillator with two transistors 10 and 10 which is a more powerful version of the simplified circuit shown in FIG. 2. It drives the LC resonant circuit which consists of the inductance supplied by the winding 30 on the ferrite shell core 11, and of the capacitor 31 which may have a value of 100 nF. In parallel to this large capacitor are the smaller capacitances of the electroluminescent lighting segments 32. They can be switched on and off by the thin-film transistors 33. These thin-film transistors, which will be explained in more detail below, can be attached to the rear glass substrate as indicated at 27 in FIG. 3. The dc pulses from a decoder 34 switch the transistors 32 into the "on" position so that the ac voltage is applied to the EL segments 32 as long as there is enough voltage on the transistor gates.

By extending this technology to multielement displays, we can address displays up to TV resolution (250.000 elements for black and white TV panels, 750.000 for color TV panels). With multielement displays, the current leads can no longer be brought out to the drivers laterally for each element. Instead, we have to place the vacuum-deposited transistor switches onto the rear glass plate in X-Y-matrix form, with means for making parallel connections to the EL-coated front plate, and with peripheral shift registers.

Before we go into construction details we have to explain how a flat TV panel can be addressed electronically in such a way that it is compatible with the existing public TV system.

In the TV vacuum tube the electron beam which scans the phosphor layer once every 1/30 second stays at each elemental point only for $10^{-7}$ second. During this time the energy for the next 1/30 second is deposited into the phosphor spot, bringing it up to extreme momentary brightness (brighter than the sun). The human eye integrates these light bursts into a steady picture, but this flicker fatiques the eye, especially in Europe where the frame period is even longer, 1/25 second.

It is impossible to scan an electroluminescent layer in this point-at-a-time fashion. The EL elements would burn out immediately from overload. Besides, the requisite high-frequency, high-current pulses could not be routed through the X-Y matrix.

The alternate line-at-a-time addressing increases the local addressing time to 60 microseconds. It requires a line storage register which accumulates the incoming point-at-a-time serial information until one line is full. Then this whole line is discharged in parallel through gates into all columns simultaneously, during 60 microseconds. Because they have no storage capability, this still demands a much higher instant brightness of the elements than they can deliver. However, the frequency and the size of the current pulses required for this have now come into a range where they can be accommodated by the X-Y matrix.

Therefore, we need line storage *and* elemental storage. When addressed by the 60 microsecond pulse, each elemental storage circuit keeps the EL element on for 1/30 second at the grey level that was commanded by the amplitude of the addressing pulse. There is no brightness surge needed. For this mammoth matrix of elemental storage circuits, we need roughly 1 million switches. They have to be placed coextensively behind the EL elements so that only a few current leads have to be brought out to the sides where this X-Y matrix must be driven by X and Y shift registers, and by the line storage register.

As the inventor has published in 1970 and 1969, only thin-film transistors (TFTs) are suitable for this application. They are polycrystalline unipolar field-effect transistors which can be vacuum-deposited inexpensively in large numbers through stencil masks onto glass plates.

After their discovery by P. Weimer, they underwent a tedious development period. As of late they have come to a state of maturity that is comparable to MOS transistors.

Figure 5A:
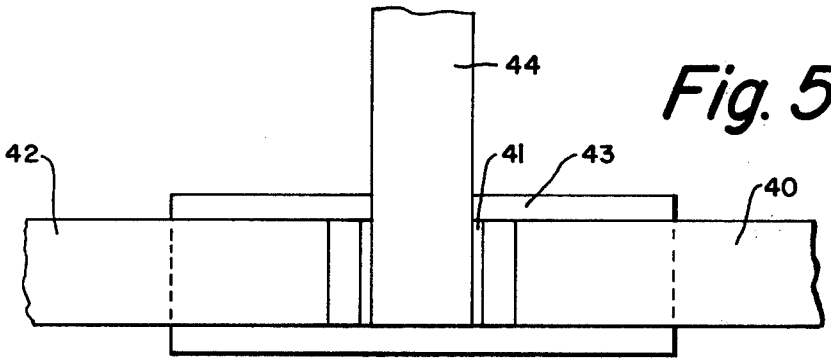
FIGS. 5A and 5B are plan and sectional views, respectively, of a thin film transistor.
Figure 5B:
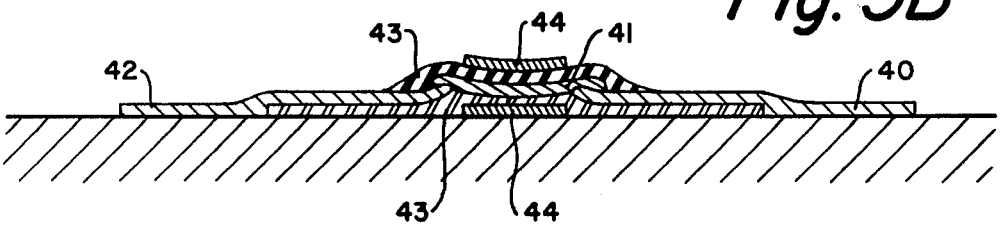

A typical TFT is shown in FIGS. 5A and B. It consists of rectangular film deposits, which simplifies mask technology. The metallic source electrode 40 delivers electron current through the thin, evaporated polycrystalline semiconductor film 41 which consists either of cadmium selenide (CdSe), or of lead sulfide (PbS), to the metallic drain electrode 42. The metal layers are about 1500 Å thick, the semiconductor layer is about 300 Å thick. The semiconductor layer is covered on both sides by an insulator such as vacuum-deposited alumina $Al_2O_3$ 43. This gate insulator layer is about 1200 Å thick. The metallic gate electrode 44 has the function to modulate the current through the semiconductor film by means of the physical process of influence. Note that the gate here is a "double gate" which influences the semiconductor 41 from both sides, thus allowing better "pinch-off" of the current. This is a special, beneficial feature of the TFT and is not possible with MOS transistors.

According to the present invention, we can prepare a complete, operational, large-area, multielement TFT matrix on glass within 20 minutes. First, we explain here our novel mammoth circuit, typically of the order of 1 square foot size, which is laid out here already for a color TV panel of half resolution (250 lines × 250 columns), see FIG. 6.

Notice that the largest part of the area is covered by the image-producing X-Y part of the matrix. It consists of the elemental storage circuits which are arrayed in matrix fashion and interconnected. Each elemental storage circuit contains an AND-gate transistor 50 which conducts only if there is a coincidence between X and Y pulses. When it conducts, it places charge on the storage capacitor 51 which is connected to the gate of the power transistor 52. The power transistor 52 acts as a variable resistor and thus determines the magnitude of the ac voltage that appears across the elemental EL capacitor 53. This ac voltage (about 50 V, 10 kHz) is supplied to the common, transparent front electrode (the $In_2O_3$-coated front glass plate) which is not shown here. Through this power transistor 52, the elemental back electrodes of the EL layer are, more or less, grounded since this power TFT is connected to the grounded grid 54.

A smaller part of the total area of the mammoth circuit in FIG. 6 is covered by the peripheral addressing circuits. They consist of the fast, horizontal shift register 55, the row of video gates 56 below 55, the line storage register 57, and the row of column switches 58.

The fast horizontal stepping shift register 55 keeps the running spot residing at each step for $10^{-7}$ second, with a periodic return every 60 microseconds. It activates serially the video gates 56, which route the incoming amplitude-modulated red-, green — and blue-information (which is supplied from the TV receiver and which, in the tube, regulates the currents of the red, the green and the blue electron beam guns) to the capacitors of the line storage register 57. As soon as this line of storage capacitors is filled up, the column switches 58 discharge all storage capacitors into the columns in parallel.

The slow, vertical shift register 59 remains at each step for 60 microseconds and returns with a period of 1/30 second. It switches the lines into the "on" condition successively by powering the gates of the respective AND-gate transistors.

Thus, with line storage and with elemental storage, the EL elements light up uniformly over the full frame period of 1/30 second without becoming overloaded. With this method of addressing, we obtain an eye-pleasing, non-flickering image, superior in this respect to the cathode ray tube. We do not require "interlacing" to reduce flicker as in the tube-type TV set, which simplifies construction.

In analogy to the color TV tube, the image triplet in the flat color TV panel consists of a red, a green and a blue part, each of which can be amplitude-modulated independently to control the hue. This color triplet consists of adjacent rectangles which form the image element which has a width-to-height ratio of 4:3.

The fabrication of these thin-film transistor matrices is accomplished by successive vacuum evaporations through different stencil masks etched out of thin metal sheet (preferably magnetic Fe-Ni alloy sheet of low thermal expansion which can be attracted tightly onto the substrate by magnets). These masks, mounted on metal frames, can be mated accurately to the glass substrate, which is mounted onto a metal frame. This occurs by means of pairs of ballpins and sockets, as illustrated in FIG. 7. In this figure, the number 60 signifies the metallic substrate frame to which are fastened, at opposite corners, two sockets 61 which contain precision-ground cylindrical bores which are opened into funnels at the underside. To the mask frame 62 are attached, at opposite corners, two ball pins 63, also precision-ground, to fit into the sockets with only 1 micron tolerance. When mask and substrate are lowered on top of each other (as explained later), ballpins and sockets slide into each other. This fixture makes possible exact registration of many subsequent masks to the same substrate.

As will be explained later, one substrate socket is bored cylindrically. The other socket in the substrate frame has an elongated hole, the large axis of this elongated hole pointing towards the socket on the other corner of the substrate frame. In this way, mask and substrate frames can not get jammed due to thermal expansion. This ballpin and socket mating, with the elongated bore to prevent jamming, is an essential part of the total process.

In a later industrial production of flat TV sets, we will employ a large, box-shaped vacuum vessel containing a row of about 10 evaporation stations, all with electron beam ovens. The stencil masks will be mounted in fixed positions above the evaporators. The glass substrate plates will be moved from station to station, and mated to the masks, by ballpin and socket fixtures. At the starting end, there will be a stack of unused glass plates. At the terminal the finished panels will be stacked onto a pile, so that the vacuum will not have to be interrupted each time a panel is finished. Production of one panel will take about 10 minutes.

Figure 8:
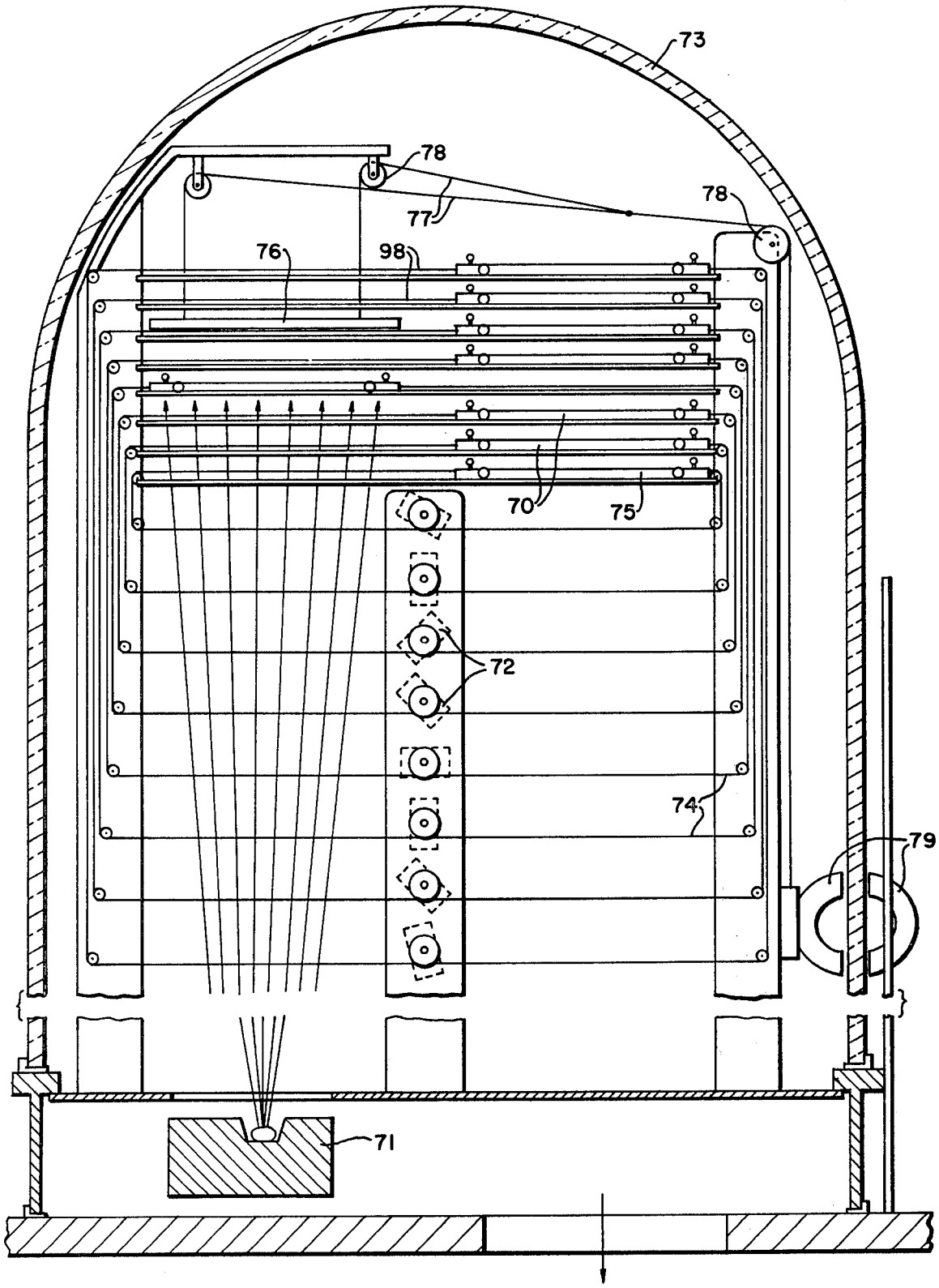
FIG. 8 is a somewhat diagrammatic view of apparatus for producing the matrix of FIG. 6.

Since at the present, we do not have the means for constructing such a plant, a compact version that fits into a conventional, cylindric bell jar of 18" diameter has been constructed. We use only one electron beam gun, but with a rotatable hearth that has 6 crucibles, each holding a different material. This system is shown in FIGS. 8 and 9. The masks 70, which run on tracks by means of Teflon wheels, can be stored on the right side, as in a chest of drawers. Each mask can be moved independently into the evaporation channel on the left side above the electron beam gun 71, by means of magnetic clutches 72 which grip through the glass walls of the bell jar 73. The magnets move the masks by means of fine steel ropes and pulleys 74. The lowest mask 75 is used as a shutter. The substrate 76 is suspended on ropes 77 and can be raised or lowered via pulleys 78 by means of shifting magnets 79.

The thickness of the deposited layers, and the rate of growth, is preferably monitored by means of resonant piezoelectric quartz crystal oscillators, with feedback to an industrial process computer. This process computer is programmed to control all sequential operations, i.e., starting, regulating and stopping the electron beam, rotating the crucible, opening and closing of the shutter, changing the masks, raising and lowering of the substrate, etc. Only in this way can human errors be avoided which otherwise would abound.

FIG. 9 further illustrates the principle of mating various masks successively to the same substrate accurately. We see the substrate glass plate 76 which is attached to the substrate frame 91. It contains the socket 92 which has a cylindrical bore, and the socket 93 which has an elongated hole. This assembly can be raised or lowered by means of steel ropes 77 and magnets 79 as explained before.

The outer mask frame 94 carries the ball pins 95 and 96 and the casters 97 which roll on the tracks 98 if the rope 74 exerts pull in one direction.

The outer frame 94 contains the inner frame 99. The stencil mask sheet 100 is attached to this inner frame 99 by means of double-sided adhesive tape. For the initial adjustment of the various masks against each other and against the substrate, a test evaporation is carried out through the first mask 100 onto the glass substrate 76. Then all other masks are placed onto the substrate successively, and the inner frames 99 are adjusted against the outer frames 94 by means of the adjustment screws 101 in reference to the evaporated test pattern while observing through a microscope. The direction of propagation of the vapor is shown by the arrows 102.

In order to attract the mask 100 tightly to the substrate 76 so as to avoid unsharp edges of the thin film transistor pattern evaporated therethrough, magnets (not shown) are placed on top of the glass substrate 76.

For this reason, the masks 100 are made of a magnetic material. INVAR (Trademark) alloy is used also because of its low thermal expansion (the assembly warms up during evaporation, which can cause inaccuracies).

The manufacturing of the masks, which is an important part of the project, can be explained as follows: We need 7 masks to complete the circuit of FIG. 6. They must be etched out of INVAR (Trademark) sheet with acid using photoresist techniques. The photomask to generate the etching pattern is a "variable aperture photomask", consisting of two superimposed sheets which can be shifted against each other and against the substrate by means of micrometer screws, the excursions being monitored by precision gauges. The two sheets have identical patterns of rectangular holes which, by shifting the two masks against each other, can form any smaller rectangular pattern as required to form TFTs and interconnections in a matrix array. To create the circuits for the peripheral shift registers which are periodic only in a line, the holes of the two X-Y masks are blanketed off except for the outermost rows.

The two identical sheets of the variable aperture photomask are made by cutting stripe patterns into commercial dual-layer plastic foil (Rubilith) and by placing two of such stripe patterns on top of each other perpendicularly. Through this, a photoresist-coated metal foil is illuminated. This is then developed and etched.

For the vacuum-deposition of a complete TFT matrix circuit including peripheral registers for a TV panel according to FIG. 6, we require 7 stencil masks and 5 different materials. A sequence of the required operations is given in the following for illustrative purposes:

(1) Load crucibles. Materials are: $Al_2O_3$ (sapphire), $Y_2O_3$, Ni-Cr for metallic layers, CdSe for the semiconductor film, $SiO_2$ for crossover insulators and coverage. The substrate glass plate is cleaned by glow discharge. The functioning of the mask moving mechanisms is checked. Then the substrate is covered by an $Al_2O_3$ film over all, to create a virginal surface for the following depositions. The vacuum is maintained at $10^{-7}$ Torr (a turbomolecular pump is suited best).

Figure 10:
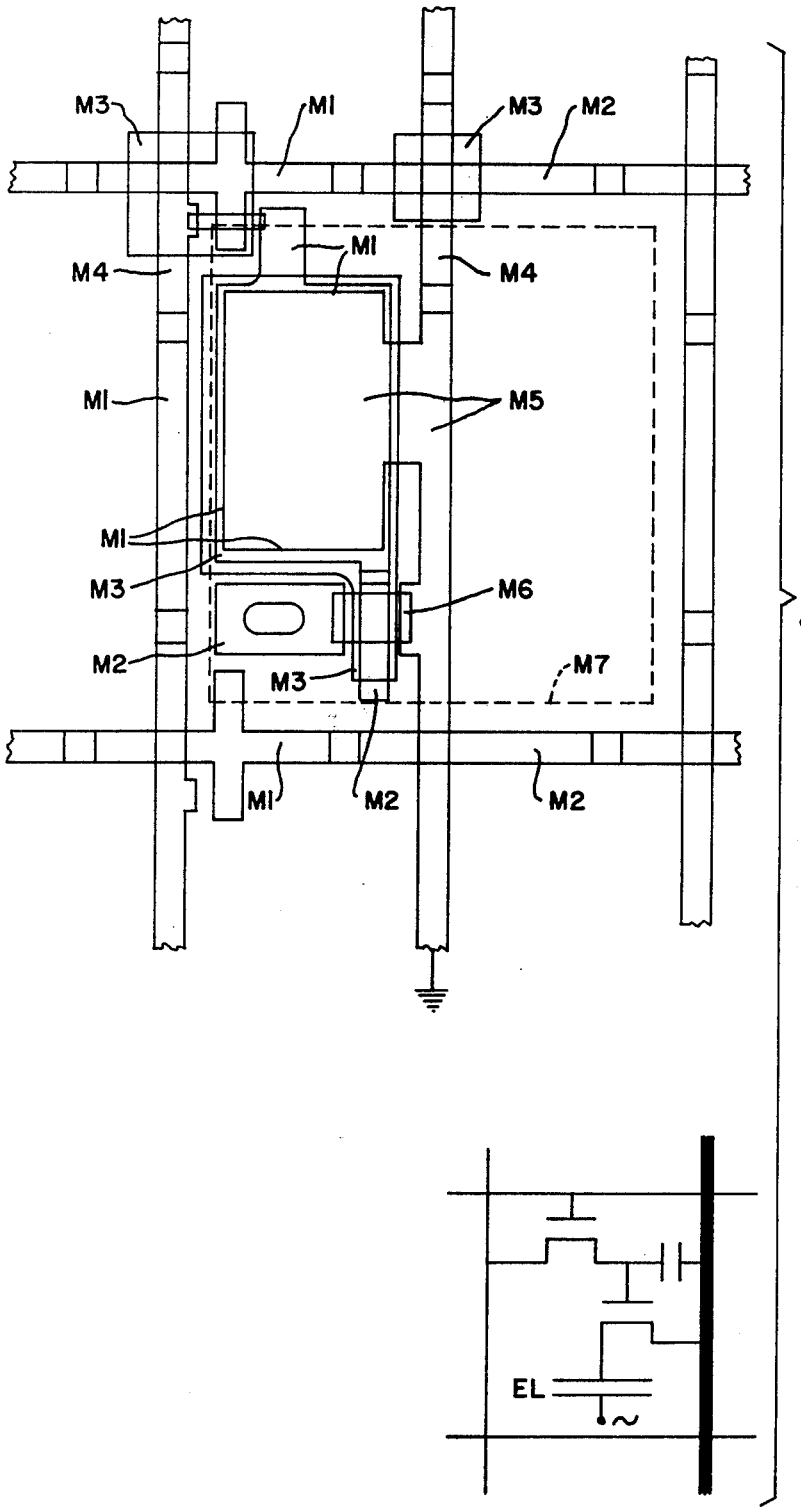
FIG. 10 is a layout of the masks used in the apparatus of FIG. 8.

(2) Mask M 1 (see mask layout for one single elemental circuit of the X-Y matrix, FIG. 10. Deposit first part of X and Y bus bars, TFT gate, drain, back plate of storage capacitor.

(3) Mask M 2: Deposit second part of X and Y bus bars, gate, power TFT drain.

(4) Mask M 3: Crossover insulators, gate insulators, capacitor dielectric.

(5) Mask M 4: Crossover Y bus bars, ground bus bar.

(6) Mask M 5: Second part of ground bus bar with capacitor top plate, power TFT source.

(7) Mask M 6: CdSe semiconductor.

(8) Mask M 3: Gate insulators.

(9) Mask M 2: Upper gates.

(10) Mask M 7: Insulator over all except EL connection pad on power TFT drain.

The elemental circuit thus formed is illustrated at the bottom of FIG. 10. 250,000 of these are deposited at the same time through the stencil mask, as described, plus the peripheral registers (for which the requisite masking is not shown here).

We have already made such masks and deposited such complete circuits. The whole process takes about ½ hour at present.

Next, the electroluminescent layer has to be applied over this large-area TFT matrix. The problems connected with this, and our solutions, are treated now.

First, the problem has to be solved that the electroluminescent layer has to emit white light for a black and white TV panel, not only blue, or green, or yellow as known so far.

According to the present invention, ac-driven ZnS power electroluminescence is uniquely suited for this. No other form of electroluminescence is capable of accomplishing white light emission, and in such a simple way. Blue-emitting and green-emitting EL powders of reasonable efficiency can be prepared relatively easily. But red-emitting EL powders are quite inefficient. If one attempts to prepare a white-emitting mixture by blending these three powders, one has to use a great amount of the feebly red-emitting powder, as compared to the green and blue powder portions. The total brightness of this white mixture is low.

In the past, recipes for white-emitting EL powders have been published. We found, however, that these white-emitting ZnS:Cu,Mn powders increase the color temperature of their white emission as the drive frequency is increased. Above 5 kHz drive frequency, they fail altogether since the yellow ZnS:Mn emission band saturates whereas the blue ZnS:Cu,Cl band of the emission keeps becoming brighter. However, as explained before, in order to obtain high brightness it is very desirable to drive these panels at frequencies as high as possible, for example, at 10 kHz.

According to the invention, there are several solutions to this problem. We found that a white-emitting mixture can be prepared which has high brightness at 10 kHz and which is insensitive to changes of the drive frequency. It consists of an intimate physical mixture of either blue-emitting ZnS:Cu,I or blue-emitting ZnS:Cu,Al phosphor powder, with yellow-emitting $ZnS_{0.2}Se_{0.8}$:Cu,Al powder, in the ratio of 30 to 70 weight percent. By increasing the blue proportion, cool-white emission can be obtained, by increasing the yellow proportion, warm-white emission is achievable quite easily. Details about phosphor preparation will be given later.

A second solution of the problem employs the effect of "cascade electroluminescence". This effect is known but was never utilized. Here we use a blue-emitting EL monoparticle layer which is embedded in resin that has been dyed with yellow-fluorescent organic pigments. The yellow fluorescence is excited by the blue EL light, part of which penetrates the layer and reaches the eye of the observer together with the yellow light (additive mixture). The same blue-emitting EL powders as mentioned above can be used. We found that the embedding resin, cyanoethyl starch-sucrose, can be dyed with Rhodamine 6G, or better, with commercially-available, daylight-excitable fluorescent pigments such as "Arc Chrome Yellow" sold by the Swada Company of London, Great Britain. In this pigment, the dye molecules are adsorbed on dust particles of clear melamine formaldehyde resin which is insoluble. This dust also acts as a light scatterer. The quantum efficiency of these organic phosphors is about 60%.

For a color TV panel where color hues are needed that are composed of the three primary colors in varying proportions, the blue-emitting EL powder can be embedded into a resin that is dyed with green and red-emitting organic pigments. Such pure pigments are fluorescein and rhodamine B. Better suited are the commercially-available, daylight-excitable pigments called "Signal Green" and "Rocket Red". As in the previous case, the color impression is gained by additive mixture of light in the human retina. It is also possible to use a blue-emitting EL powder and a green-emitting EL powder and to embed an appropriate mixture of these in resin that has been dyed with red-fluorescent organic pigment such as rhodamine B, or better, with commercial "Rocket Red", but this has disadvantages due to different aging rates.

Figure 11:
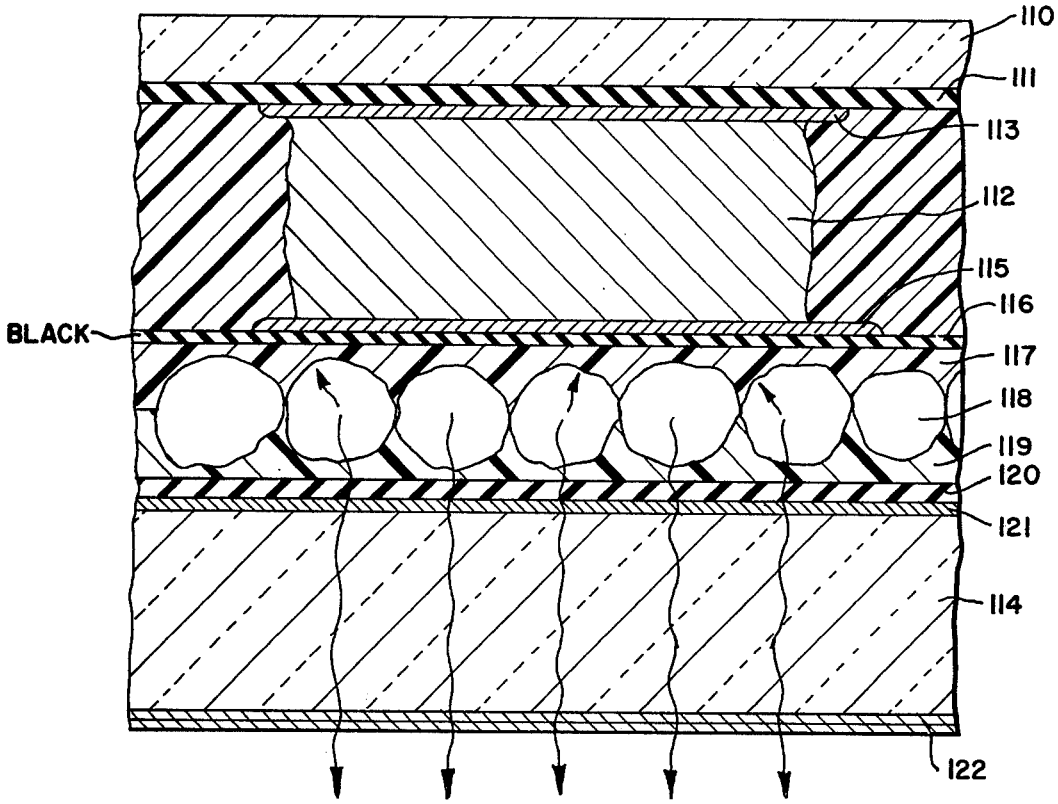
FIG. 11 is a sectional view of a black and white TV panel.

The sequence of layers that has to be used, according to this invention, to prepare a black and white TV panel, is delineated in FIG. 11. Starting from the top we have the rear glass substrate 110 which carries the TFT matrix circuit 111 prepared as described previously. Then follows the conducting resin conductors 112 which have been applied to the matrix 111 by silk screening onto the EL pads 113, and which may be similar to the connectors 26 of FIG. 3. Onto this rear substrate is lowered, while the connectors are still wet, the front substrate 114, in exact registration so that electrical connection is made to the metallic rear electrodes 115 of the EL layer. The layer sequence of the front substrate starts with the metallic electrodes 115, to be followed by the rear oxide film 116 which is black, the rear resin layer 117 that can be dyed with absorbing organic pigment, and the EL monograin layer 118 which can consist of just blue-emitting EL particles, or which can consist of a mixture of blue-emitting and of yellow-emitting EL particles as described. The next layer is the front embedding resin layer 119 which can be dyed with fluorescent molecules, to be followed by the transparent, insulating oxide layer 120 for puncture-protection, and the transparent conducting common front electrode 121 which is attached to the front glass plate 114 that was cited already. This can, optionally, have an anti-reflex coating 122 to improve visual contrast of the display.

Figure 12:
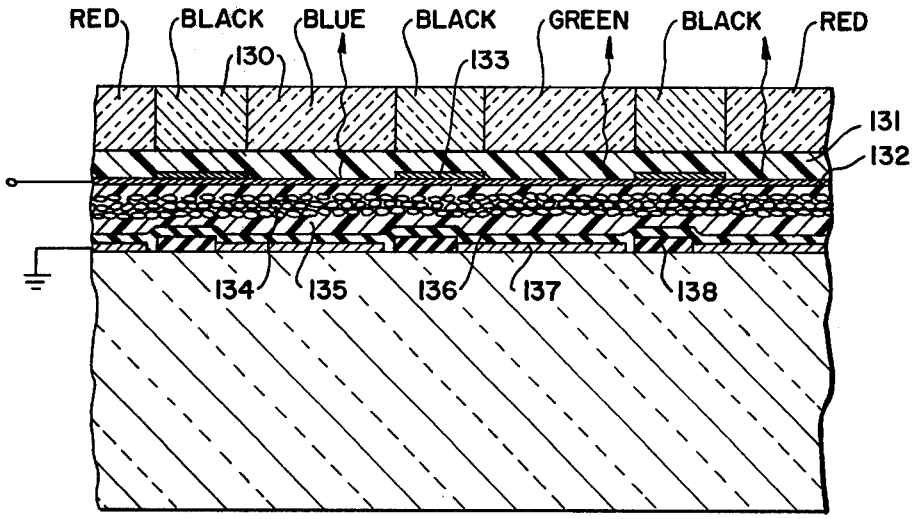
FIG. 12 is a sectional view of a color TV panel.

The simplest method to produce a color TV panel is to prepare a white-emitting panel similarly as described but using a suitable three-color EL mixture (e.g., blue primary EL powder embedded in green and red fluorescent resin), and to place over it, in exact registration of patterns, a positive color film sheet, e.g., Agfa or Kodak photographic film, in which a triplet raster of red, green and blue color filter dots has been produced by suitable exposure through photomasks (which can be similar to the vacuum evaporation masks used in TFT manufacture), and by developing. The grid between the rectangular filter specks is black. This panel is illustrated in FIG. 12. The mosaic filter sheet 130 is glued to the front of the EL layer by means of clear epoxy resin 131 whereby the exact registration can be accomplished by shifting during simultaneous microscopic observation while the resin is still liquid. Reference numeral 132 signifies the common transparent front electrode of the EL layer which here is made of a thin, vacuum-deposited gold or silver film that is sandwiched by $Bi_2O_3$ films. Its conductivity can be reinforced by a grid of thicker, opaque metal stripes 133 which are positioned where no light transmission is required. Since this type of color TV panel suffers, of course, from absorption of EL light in the mosaic filter, the EL brightness has to be increased as much as possible, for example, by using a triple monograin EL layer 134. Preferably, only blue-emitting EL powder is used, embedded in green and red fluorescent resin 135, so that the aging of the EL powder does not lead to a change in hue or color temperature. The organic dyes show almost no aging. In this figure, only one insulating layer 136 for puncture protection is shown. The EL back electrodes 137 which are powered by the TFT matrix 138 are carried out silvery reflecting here, to increase brightness of the display, for the reasons explained. Instead of directly applying the EL layer on top of the matrix as shown here, it is also possible to keep the TFT matrix on one substrate, and the EL layer with a filter on another, with multiple connectors as described before.

Often, it is desirable to abandon the mosaic filter sheet with its need of exact registration, and with its absorption. For color, the EL layer can now no longer be one, uniformly white-emitting layer but it has to be rastered into red, green and blue-emitting triplet dots like in the conventional color TV tube. Only for black and white, a uniform, unpatterned white-emitting layer can only be used. But it has to be covered on its front face by a superimposed intransparent grid (which can double to reinforce the conductivity of the transparent front electrode) in registration with the grounded X-Y bus bars of the TFT matrix, because between them and the front electrode the full alternating current voltage is present most of the time, without modulation, so that the EL layer there is lit constantly. This light is absorbed by the grid 133. For color TV, this simplified version is not possible but it is necessary to produce red, green and blue-emitting raster dots exactly on the TFT-driven back electrode pads of the matrix and nowhere else.

Figure 13:
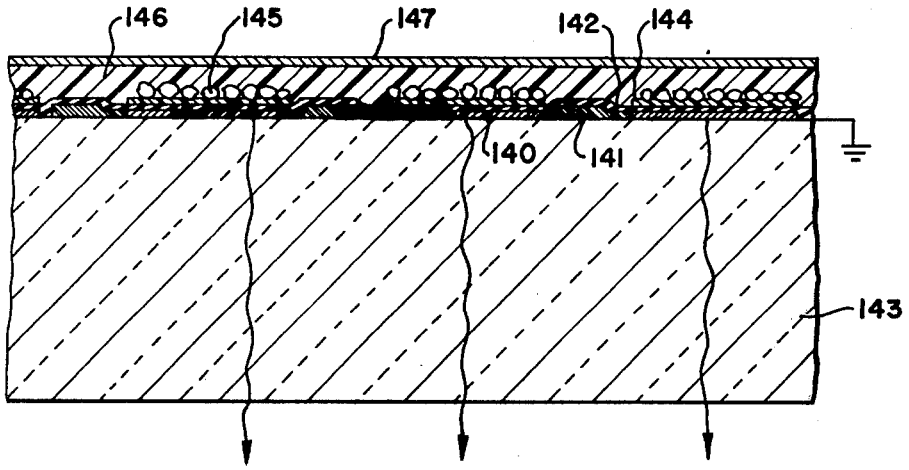
FIGS. 13 and 14 are sectional views of modified forms of TV panels.

This can be done, according to the invention, as shown in FIG. 13, which depicts one variant of several possible other ones. The TFT-driven elementary EL electrode pads in the X-Y matrix are deposited here in transparent form, for example, using a thin gold film sandwiched by bismuth oxide films 140. Then the whole matrix, including the intransparent TFTs 141 and bus bars, is covered by a film of puncture-protecting oxide 142 as used before. The total substrate face is now covered with photoresist lacquer and is illuminated through the glass substrate 143 with actinic light. The exposed parts of the photoresist will cross-link and photopolymerize, thus becoming insoluble. The unexposed parts can be dissolved by developing. The undissolved parts 144 are now made thermoplastic and tacky by warming of the panel on a hot plate, and are sprinkled with EL powder to form a monoparticle layer as we have seen before, but now in the form of a raster pattern 145. After cooling, the unattached particles can be tapped off. If a black and white panel is desired, all pads can be covered with the same powder in this way, and the rear resin layer 146 can now be sprayed on. The EL particles can be blue-emitting, and the resin can be dyed yellow-fluorescent, as before. This is followed by the intransparent back electrode 147.

For color TV, the blue, green, red raster requires that we first prepare the blue raster in the above-described way. But we do not yet cover the monoparticle pads with resin. We now coat the whole panel again with photoresist and expose the green electrode pads, through a suitable photomask. The subsequent development of this photoresist does not affect the blue monoparticle pads made before. Warming of the panel now makes the green photoresist pads tacky, and green EL powder is adhered to them as before, so that the second, green EL subraster has now been formed. To form the red subraster, the procedure can be repeated if an efficient, red-emitting EL powder is available. In the absence of this, the third photoresist layer that is applied now has to be dyed with red-fluorescent molecules. Blue-emitting EL powder is adhered to these pads. The rear embedding resin that follows now has to be applied not uniform by spraying but in patterns by printing, the resin behind the last pattern being dyed with red-fluorescent molecules.

Figure 14:
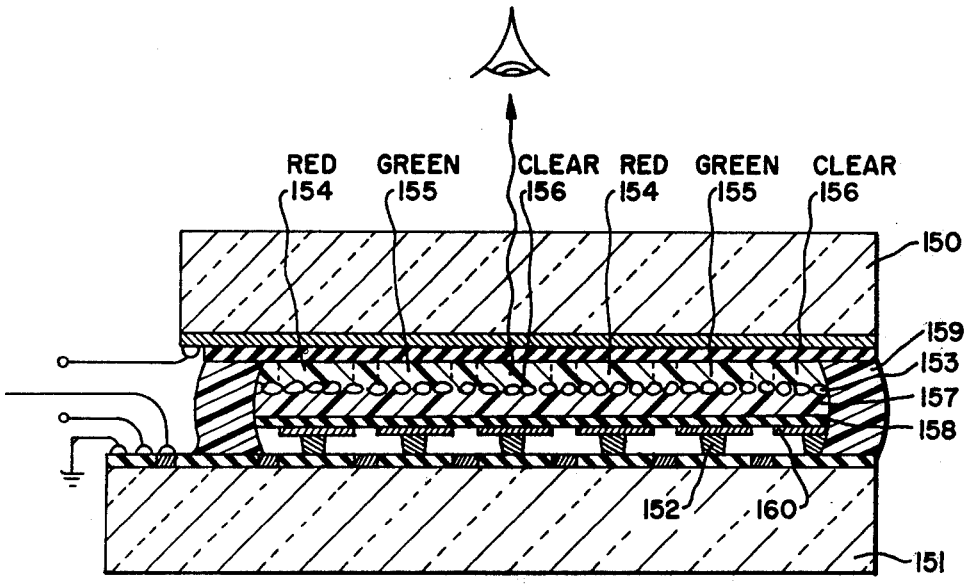

This structure has several obvious drawbacks which leads us over to the description of our preferred structure, depicted in FIG. 14. This covers black and white and color TV and embodies all the advantages, avoiding all the drawbacks. It employs two substrates, the front EL plate 150 and the rear matrix plate 151, connected by multiple parallel connectors 152. In this way, the contradictory preparation conditions (i.e., vacuum technology for the matrix plate, and paint technology for the EL plate) can be kept separate. Also, later repair service becomes easier since not the whole device has to be discarded if one part fails. The EL plate now again contains only uniform layers, easily applied by paint technology. No longer do large parts of the EL area remain unused because the bus bars, or the circuit components of the elementary circuits, do not allow controlled modulation of the electric field there. The lighting area is determined only by the EL back electrodes which can be placed very close together. As the primary light emitter we use only blue-emitting EL powder in form of one uniform monoparticle layer 153 that is applied over the whole panel. Thereby, no shift of color hue can occur due to differential aging of two kinds of EL powders. Also, only this blue EL powder has to be improved for better performance. This monoparticle layer is embedded in our high-dielectric resin undiluted by photoresist resin of lower dielectric quality as was required in the previously-described design (FIG. 13). This resin can be dyed with organic pigments. For black and white, "Arc Chrome Yellow" pigment is used uniformly, i.e., the EL layer is unpatterned. For color TV, however, the blue-emitting EL monolayer must be embedded into high-$\epsilon$ resin stripes which are dyed in triplet fashion into red-fluorescent stripes 154, green-fluorescent stripes 155, and clear resin stripes 156. The latter can, for purposes of equalization of light intensity, contain a neutral, grey absorbing pigment.

In one method, these triplet resin stripes are applied by spraying the dissolved resin through stripe masks made of self-adhesive, peelable tape that is glued to the glass plate. First, the red-fluorescent resin stripes are sprayed on. The masking tape stripes are pulled off, replaced by others at a slightly shifted position, and the green resin stripes are sprayed on. The masking tape stripes are again removed and replaced by a different set, and the clear resin stripes are sprayed on. The whole plate can now be warmed to become tacky, and the uniform EL monoparticle layer is applied.

Instead of the adhesive tape masks we found that stripe masks etched out of very thin (25 microns) steel foil can be used with advantage. They have to be attracted tightly to the substrate by magnets (cobalt-samarium) behind the substrate. Silk screening was also used with success. A photoresist technique by which the stripe masks were made of polyvinyl photoresist which is soluble in water whereas our high-$\epsilon$ resin is not, was also applicable.

The EL monograin layer on these triplet resin stripes is now covered by the rear resin layer 157 which can be dyed dark with organic pigments, for contrast enhancement of the display in bright ambient. Then follows the black oxide insulator film 158 that is deposited in vacuum. This vacuum treatment also brings about a thorough drying of the resin and of the phosphor, which is beneficial for long life of the panel. The EL back electrode pads 160 are applied through a mask, to be followed by the conducting resin connectors 152 which consist of a silicone resin which is loaded with silver powder. After fitting the two plates 150 and 151 together accurately by means of jigs and after adding some desiccant powder (not shown), the edges of the panel are then sealed as hermetically as possible with epoxy resin 159 that is loaded with a powder which acts as a humidity barrier. We found, in addition, that the color saturation of the green and of the red emission can be improved if the respective fluorescent resin stripes contain, on the side toward the glass plate and away from the phosphor, a yellow, non-fluorescent pigment which absorbs the residual blue light which otherwise would reach the eye of the observer and desaturate the color hue (not shown). This concludes the description of our improvements of the layer structure.

To be described last in this invention, we also made improvements in the preparation of EL phosphor powders that are used in our display panels. For our preferred flat TV panel design as depicted, for example, in FIG. 14, we need blue-emitting EL powder, with the maximum of its Gaussian emission curve near 470 nm. It must not display the common shift of emission color with operating frequency (most EL phosphors shift emission color to shorter wavelengths, for example, from green to blue, if the drive frequency is increased, say from 5 kHz to 8 kHz). Moreover, we need EL phosphors which have long life at 10 kHz operation. Most phosphors have a half-life of only about 100 hours under these conditions.

For another type of black and white TV that has been described already in the foregoing, we need a yellow-emitting EL powder, to be mixed with the blue-emitting one to result in white emission by additive light mixture. This yellow EL powder also has to be long-lived and frequency-stable in operation at 10 kHz. The same is true for numeric indicators where a green-emitting powder, with emission in the eye sensitivity maximum at 55 nm, is suited best.

It is known that the blue-shift of emission color which occurs on increasing the drive frequency does not occur in ZnS:Cu EL powders that are coactivated with iodine, i.e., ZnS;Cu,I, and that it does not occur in aluminum-coactivated phosphor ZnS;Cu,Al. The blue-shift is only present in bromine and chlorine-coactivated ZnS-type phosphors. The drawback is that the stable ZnS:Cu,Al does not emit a saturated blue, since there is a weak orange side band present in its emission, and that the stable ZnS;Cu,I is relatively short-lived.

According to the present invention, we found preparation methods which avoid these drawbacks. The raw ZnS powder is first pre-fired at 600° C. in a pure $H_2S$ gas stream to remove all traces of oxygen, humidity and oxides. This powder is then doped with CuCl and $AlI_3$, or with the orresponding copper and aluminum halides, in equal molar proportions. Both salts are dissolved in methanol or ethanol. After drying, the powder is then fired for 2 hours at 950° C., and cooled slowly, in flowing $H_2S$. The cold powder is washed in 10 mol percent KCN solution to remove the exuded copper sulfide from the surfaces. Then it is refired for 3 hours at 550° C. submerged in liquid sulfur under 100 atm. of nitrogen pressure to prevent the evaporation of the sulfur (boiling point at 1 atm. of sulfur is 420° C.). This is done in a pressure autoclave. After cooling, the sulfur is leached out with $CS_2$ and dissolved in KCN solution. Now the powder is boiled 1 hour in phosphoric acid which forms an insoluble zinc phosphate skin around each particle, thus passivating its surface. This powder, after washing and drying is now ready for use. It has long life (greater than 10,000 hours) when operated at 10 kHz, and it emits a saturated blue light.

Similarly, we have prepared a yellow-emitting powder which shows no color shift if the drive frequency changes, and which can be operated at 10 kHz for more than 10,000 hours before having dropped to half its initial brightness. The raw powder mixture here in 20 mol percent ZnS and 80 mol percent ZnSe. After doping with alcoholic copper and aluminum halide solution at a concentration range between 0.1 and 0.01 mol percent, and after drying, this mixture is then fired for 3 hours at 850° C. in flowing $N_2$ + 20% $H_2$ (forming gas). After cooling and washing of the exuded copper with KCN solution, this powder is then refired for 3 hours at 500° C. submerged in molten sulfur-selenium composed of the same molar proportions as the ZnS-ZnSe powder mixuture under 100 atm. of nitrogen pressure (to prevent the S-Se liquid to boil off). After cooling, the S-Se is leached off with concentrated KCN solution. The powder obtained in this way is now boiled in concentrated phosphoric acid to produce zinc phosphoric acid to produce zinc phosphate skins for surface passivation. This powder can now be embedded in resin and used in EL panels.

In an analog fashion, we have prepared frequency-stable, long-life green-emitting EL powder that is matched to the eye sensitivity maximum, for use in numeric display panels. Briefly, the pre-fired, oxygen-freed raw ZnS powder is mixed with 20 mol percent of similarly-treated CdS powder and is doped with alcoholic copper-aluminum halide solution as before. After drying, it is fired for 3 hours at 800° C. in $H_2S$. After cooling, it is washed in KCN solution to remove the exuded copper from the particle surfaces and refired submerged in liquid sulfur at 500° C. for 3 hours under nitrogen pressure to prevent the sulfur from boiling off. After recuperating the powder from the sulfur it is then phosphated, for surface passivation. The powder is now ready for use.

These three preparational recipes have the following features in common which constitute a part of the present invention: The halogen that is introduced into the ZnS or $ZnS_x$-$Se_{1-x}$ or $Zn_xCd_{1-x}S$ lattice by the dopant is used to act as a chemical transporting agent which promotes crystal growth during the first hour of the high-temperature firing process. This leads to well-formed microcrystallites or powder particles. These well-formed crystallites are essential for high luminous efficiency of the EL powder. This good crystallization would not have occurred had the halogen not been present.

During the prolonged firing, the volatile halogen atoms distill out of the particles and are carried away by the flowing stream of the firing atmosphere. The aluminum and copper ions, which are involatile, remain back in the lattice. Later, during the prolonged operation of the finished EL powder, the aluminum will be a much slower diffuser than the halogens. The use of it instead of the halogens for coactivation is, therefore, prolonging the EL life. Moreover, the halogens which will be exuded from the particles during prolonged operation would be very corrosive and would contribute to the aging process in this way, too. This is no longer possible with only aluminum coactivation. Yet, due to the initial presence of the halogen we have the well-crystallized particles. After loss of the halogen we have the stability due to immobile aluminum, and no corrosion due to halogen.

The refiring of the powder at intermediate temperature in contact with sulfur has the purpose to drastically reduce the concentration of sulfur vacancies in the lattice. Sulfur vacancies are harmful because, owing to their negative electric charge, they facilitate the diffusion of the positive copper ions. Without this space charge compensation, the copper ions will be stuck which is desirable because the diffusion of copper ions within the grains is the main source of aging. Referring to the mechanism described at the beginning, we believe that the conducting, acicular Cu-precipitates which are crucial for the EL mechanism, disappear gradually during aging, due to out-diffusion to the surface. The EL mechanism becomes thus inoperative. This aging process is now impeded by removing the sulfur vacancies which are a necessary prerequisite for it to occur. Besides, the removal of the sulfur vacancies suppresses the desaturating orange side band emission of ZnS:Cu,Al (the so-called Froelich band which involves a sulfur vacancy in the luminescent center) and thus helps to produce the saturated deep blue emission needed for color TV.

In the ZnS-CdS host lattice mixture, this reheating in sulfur at 500° C. leads additionally also to the conversion of the hexagonal (non-electroluminescent) lattice structure, which the high CdS-content enforced onto the ZnS lattice, back to the cubic lattice structure (electroluminescent), a process that is already known through the work of W. Lehmann.

Finally, the novel process of phosphating the particle surfaces by boiling in phosphoric acid has the purpose to prevent that unbound electrons which oscillate back and forth in the particles, can leave the particles and enter the resin. There they cause local electrolysis at the ZnS-resin interface, with decomposition and gas formation. The lattice (sulfur) vacancies that are created at these corroding interfaces can migrate into the crystallites and enhance harmful copper diffusion, as explained above. After the phosphate passivation, the unbound electrons are stopped at this inorganic barrier and cannot enter the resin. This prevents surface corrosion and vacancy generation.

This concept of the EL aging process, and its suppression by the preparational measures described above, is novel. After having achieved, within the course of this invention, operation at low voltage and with high visual contrast, this solution of the aging problem makes EL displays truly practical for the first time. The most important practical structures where this is utilized, numeric displays and black and white and color TV, have been described in this invention, too.

What is claimed is:

1. A display panel comprising a body of insulating resin having a layer of electroluminescent particles embedded therein, said layer being a single particle in thickness, said resin having a dielectric constant higher than that of said particles and said resin including fluorescent material on at least one side of said layer, insulating coatings on both front and back surfaces of said resin body, a transparent front electrode extending over the insulating coating on said front surface, a back electrode disposed on the insulating coating on said back surface, at least one element of said display panel adjacent the back thereof being black and sufficiently opaque to absorb substantially all the light reaching it, and means for electrically energizing said electrodes.

2. A display panel as defined in claim 1 in which the insulating coating on at least the front surface of the resin body is a refractory oxide and the insulating coating on the back surface is black.

3. A display panel as defined in claim 1 in which said resin consists of cyanoethyl starch containing cyanoethyl sucrose as a plasticizer.

4. A display panel as defined in claim 1 in which said electroluminescent particles emit blue light when excited and said resin body consists of three components arranged in a predetermined pattern, the first of said components including red-emitting fluorescent material, the second component including green-emitting fluorescent material, and the third component being clear resin.

5. An electroluminescent display panel comprising a transparent front electrode, a transparent insulating film, an insulating resin body having a layer of electroluminescent particles centrally embedded therein with a thickness of one particle, a black insulating film, and a plurality of opaque back electrodes, said insulating films being applied as a coating on front and back surfaces of said resin body respectively and said front and back electrodes being disposed directly on the respective insulating films to form a symmetrical multi-layer structure, and means for selectively electrically energizing the back electrodes.

6. A display panel as defined in claim 5 including a glass plate carrying a plurality of conductors corresponding in number to said back electrodes, means for sealing said glass plate to the back of the display panel over the back electrodes, and means for connecting each of said conductors to the corresponding electrode.

7. A display panel as defined in claim 6 and including means on said glass plate for selectively energizing said conductors to energize the back electrodes.

* * * * *